US007513080B1

(12) United States Patent
Showalter

(10) Patent No.: US 7,513,080 B1
(45) Date of Patent: Apr. 7, 2009

(54) ANCHOR ATTACHMENT FOR A ROOF PANEL RIB

(76) Inventor: Gregory Showalter, 5621 SW. Winthrop St., Seattle, WA (US) 98116

( * ) Notice: Subject to any disclaimer, the term of this patent is extended or adjusted under 35 U.S.C. 154(b) by 783 days.

(21) Appl. No.: 10/810,114

(22) Filed: Mar. 25, 2004

(51) Int. Cl.
*E04B 1/38* (2006.01)

(52) U.S. Cl. ..... 52/24; 52/545; 52/588.1; 403/373

(58) Field of Classification Search ..... 52/24, 52/25, 26, 745.21, 545, 528, 540, 536, 538, 52/698, 588.1; 403/362, 388, 381, 373, 83
See application file for complete search history.

(56) References Cited

U.S. PATENT DOCUMENTS 5,228,248 A 7/1993 Haddock
5,483,772 A 1/1996 Haddock
5,694,721 A 12/1997 Haddock
5,732,513 A 3/1998 Alley
6,164,033 A * 12/2000 Haddock ..... 52/545
6,688,047 B1 * 2/2004 McNichol ..... 52/25
2002/0088196 A1 * 7/2002 Haddock ..... 52/543

* cited by examiner

*Primary Examiner*—Richard E. Chilcot, Jr.
*Assistant Examiner*—Anthony N Bartosik
(74) *Attorney, Agent, or Firm*—David L. Tingey

(57) ABSTRACT

A roof anchor with a channel fits over a roof panel rib typically having a rib head supported by a narrower rib neck. Setscrews on the anchor side thread through matching threaded holes in anchor sides and into the channel, sandwiching a roof panel rib therebetween when it is received into the channel. To prevent the anchor from lifting off the roof panel rib, the setscrews are located on the anchor sides low in the anchor channel engaging the roof panel rib at the narrow rib neck such that the roof panel rib head can be received between the setscrews and the anchor top. A rib bar typically shaped to functionally match the roof panel rib may be inserted within the roof panel rib as a brace to prevent a roof panel rib from collapsing under force of the setscrews.

1 Claim, 6 Drawing Sheets

ANCHOR ATTACHMENT FOR A ROOF PANEL RIB

BACKGROUND

1. Field of the Invention

This invention relates to attachments for roof panels, and more specifically, to an anchor mountable to a roof panel rib, to which roof paraphernalia may be attached, and the unique setscrew that secures to the roof panel rib.

2. Prior Art

Metal roof panels are in common usage. With such usage, it is often an advantage to attach equipment to the roof panel. For example, snow guards that control snow and ice sliding on the roof, cable guy wires, walking platforms, piping, signage, brackets, etc. It is important that such attachments not penetrate the roof panel so leaks are not introduced.

Metal roof panels are commonly joined with a raised portion on a first side overlapping a raised portion of an adjacent panel, together forming a roof panel rib raised above the general roof panels. In addition, some metal roof panels have an intermediate rib between the overlapping adjacent panel ribs. The panels are installed with the roof panel ribs running with the roof pitch, so an attachment anchor clamped on the rib can be positioned essentially anywhere on the roof, either laterally by choosing an appropriate rib and vertically along the pitch.

Because the attached paraphernalia may constitute a significant load on the anchor, such as a large sign or a snowfall collection, the anchor attachment must be able to sustain such loads without sliding on or disengaging from the roof panel rib. To prevent sliding and still not penetrate the roof panel, the anchor should have a friction or clamping attachment to the roof panel rib to allow the anchor to support the required loads. To achieve an attachment that can sustain loads of many hundreds of pounds, the anchor is clamped to the rib with a comparable force. To prevent disengagement from the roof panel rib, preferably the anchor should have structural features interconnecting with panel rib structural features that prevent lift-off regardless of friction.

A thin-walled roof panel rib is typically unable to sustain the clamping force required to keep the anchor from sliding on the roof panel rib without permanently deforming the roof panel rib. Once deformed, the roof panel rib is unable to readily come apart or go back together for roof panel replacement. The deformation disrupts the mechanism of the panel rib and is aesthetically displeasing. It is therefore also an advantage to have an anchor securable to a thin-walled metal roof panel at a roof panel rib without significantly deforming the roof panel rib or disrupting the panel interlock with the adjacent metal panel.

SUMMARY OF THE INVENTION

These objects are achieved in a roof anchor comprising a two opposing sides depending from an anchor top forming a channel adapted to fit over a roof panel rib. At least one attachment setscrew is threaded into a hole in the anchor top for attaching roof paraphernalia to the anchor after the anchor is secured to the roof panel rib. Clearly, any similar attachment device may substitute for the attachment setscrew and is deemed included in the anchor. Opposing setscrew on each anchor side thread through matching threaded holes in anchor sides and into the channel, sandwiching a roof panel rib therebetween when it is received into the channel.

To prevent a roof panel rib from collapsing or suffering severe deformation under clamping force of the setscrews, a rib bar typically shaped to functionally match the roof panel rib is inserted within the roof panel rib as a brace. When the anchor setscrews tighten against the roof panel rib, the panel rib sides are sandwiched between the rib bar and the setscrews. The bar sustains the clamping force thereby maintaining the shape of the roof panel rib.

Typically, a roof panel rib comprises a head supported on a thinner neck, matching the shape of the roof panel rib. To prevent the anchor from lifting off the roof panel rib, the setscrews are located on the anchor sides low in the anchor channel, sufficiently apart from the anchor top so that the roof panel rib head can be received between the setscrews and the anchor top. The setscrews then tighten into the roof panel rib at the roof panel rib neck where the neck meets the head. When the setscrews are threaded into the channel under the head, the anchor is prevented from lifting off the roof panel rib, independent of the frictional clamping force that might be applied by the setscrews against the neck. To avoid damage to the head and the neck by threads of the setscrew, the screw threads end intermediate the setscrew, leaving a smooth rod terminating on a setscrew abutment surface. That is, with the setscrew engaging the roof rib with a portion of the head portion and a portion of the neck portion extending outward toward the setscrew, setscrew threads continuing to the setscrew end as in a traditional set screw would cut into and damage the roof rib. It is therefore necessary to end the threads well short of the setscrew abutment surface. Also, for the same reason that the setscrew is not engaging a flat surface, it is necessary in order to not cut into and damage the roof rib that the end of the set screw not present corners that would likely cut into the roof rib but rather end in a curved surface the tapers and blends a curved abutment surface smoothly without discontinuity into the smooth, unthreaded rod portion.

DETAILED DESCRIPTION OF THE PREFERRED EMBODIMENTS

Figure 1:
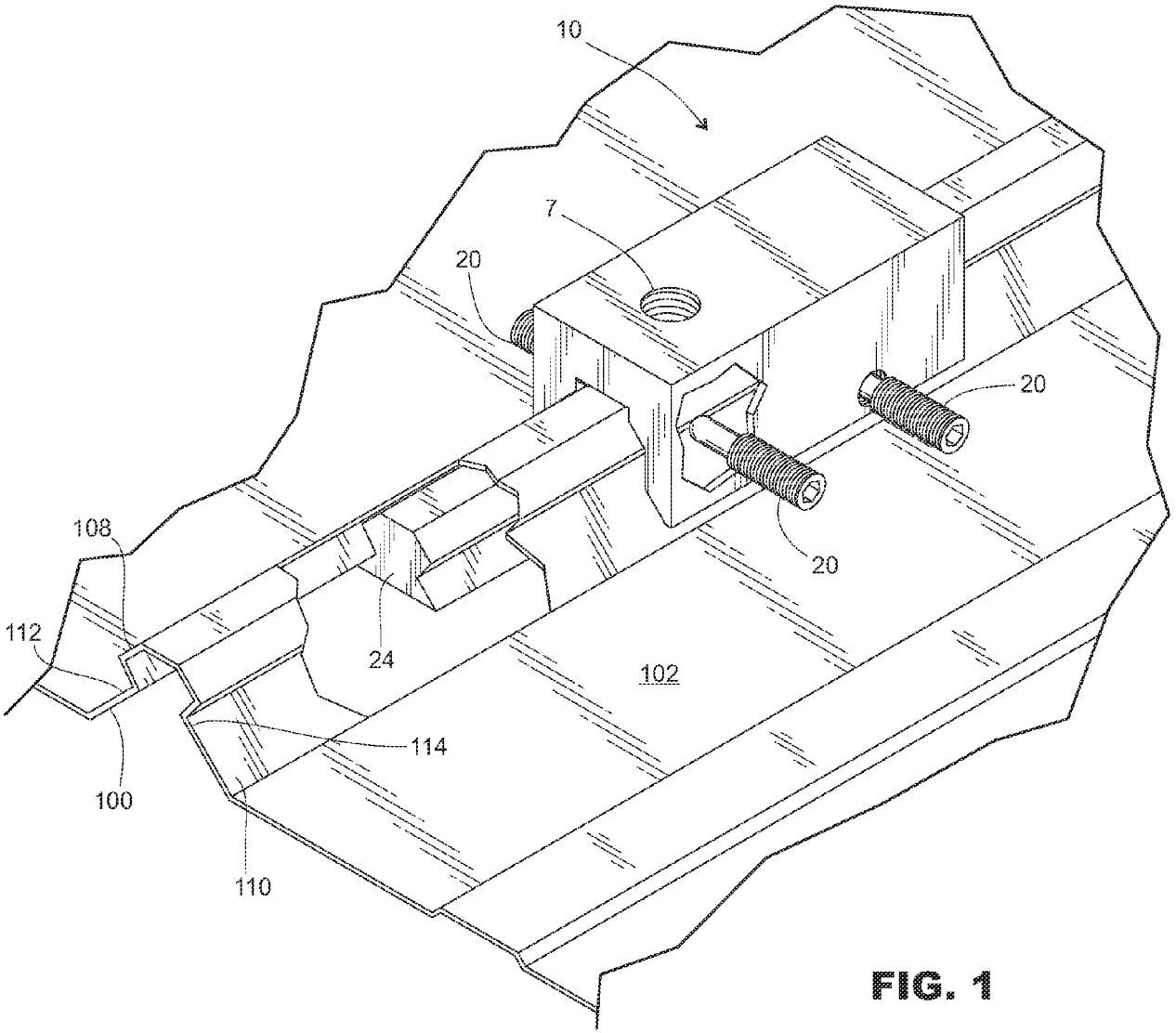
FIG. 1 is a perspective cut-away view of the anchor mounted over a roof panel rib with a support bar within the rib sustaining the rib from collapse as setscrews in the anchor tighten against the rib at the intersection of the roof panel head and neck. setscrew high in the anchor channel collapsing a roof panel rib within the channel.
Figure 2:
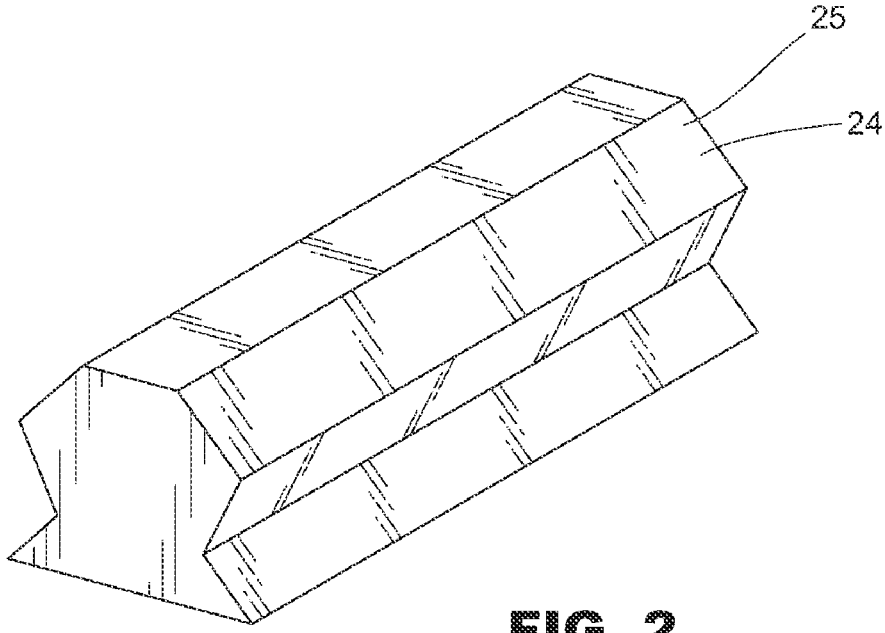
FIG. 2 is a perspective view of the support bar shown in FIG. 1.
Figure 3:
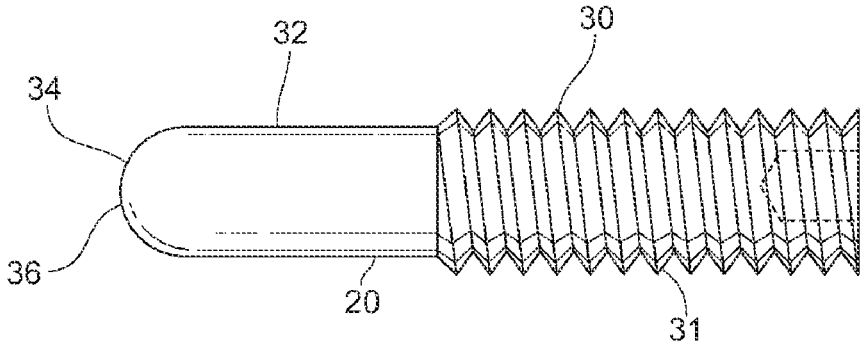
FIG. 3 is a side view of the setscrew shown in FIG. 1.
Figure 4:
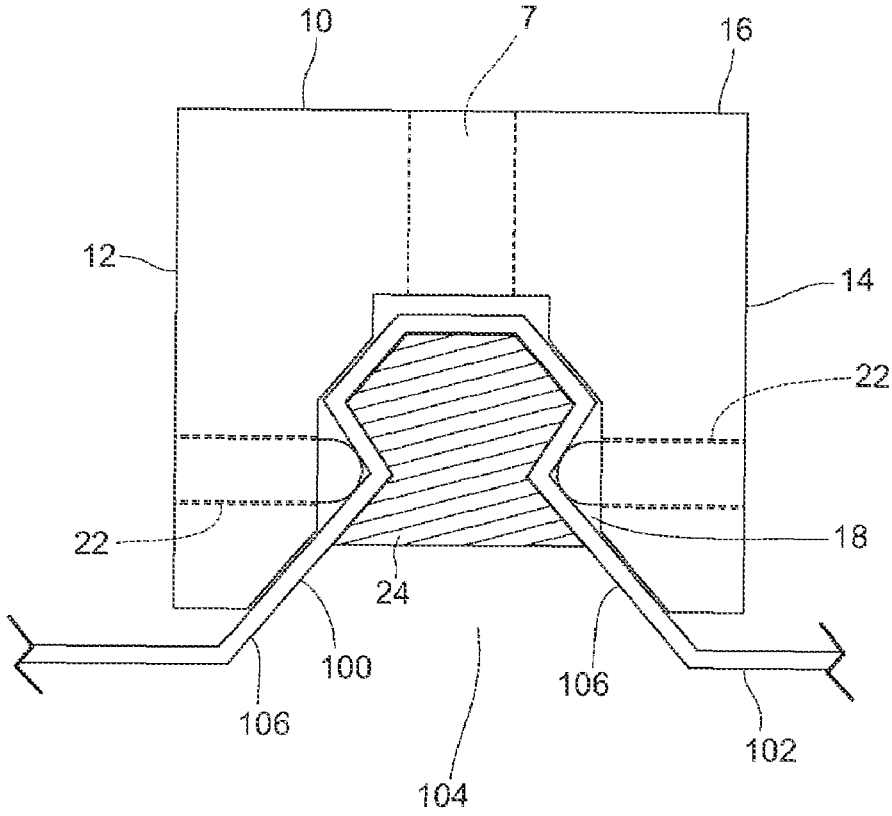
FIG. 4 is an end view of the anchor of the present invention showing setscrews in the anchor channel and a support bar within matching the rib shape to support the rib as the setscrews tighten against the rib.
Figure 5:
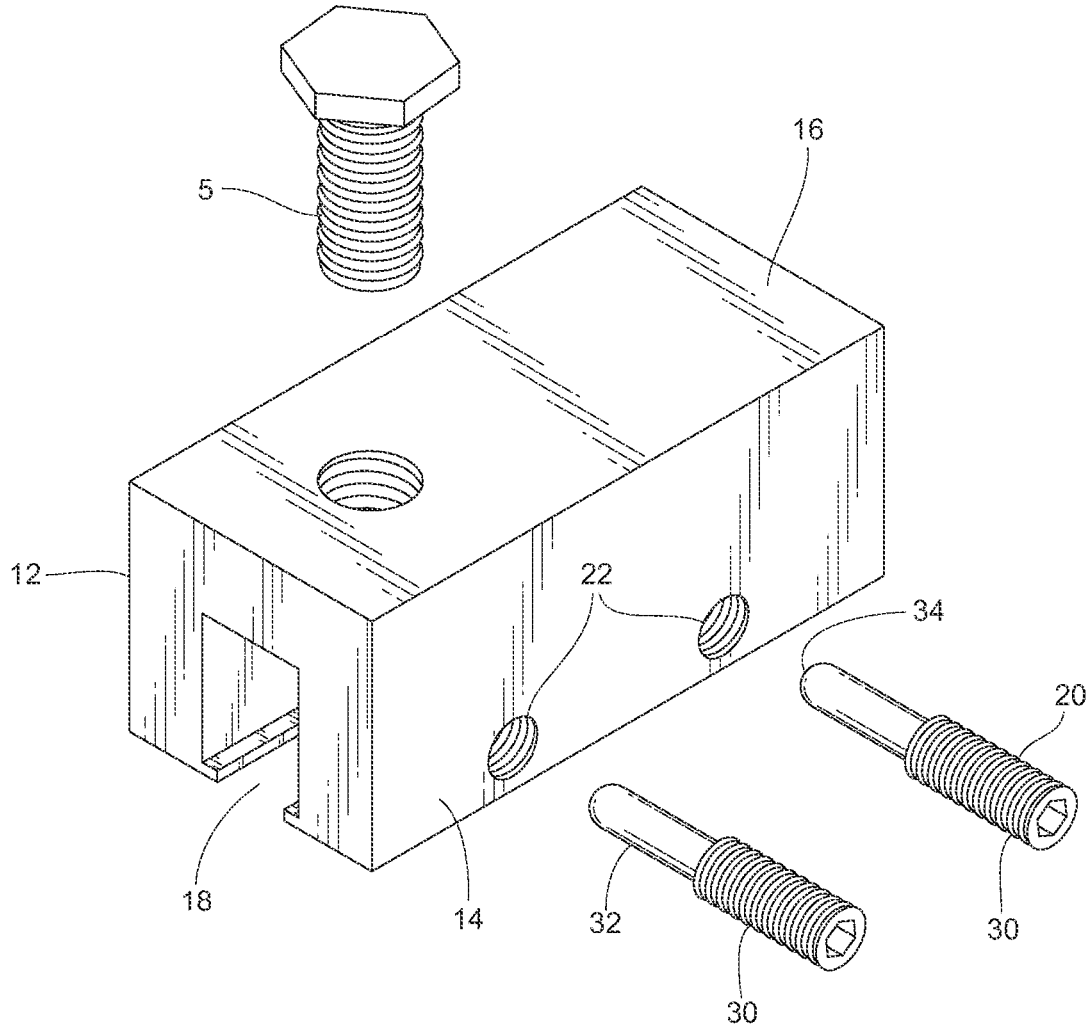
FIG. 5 is a perspective view of the anchor shown with two set screws entering the anchor from the same side.
Figure 6:
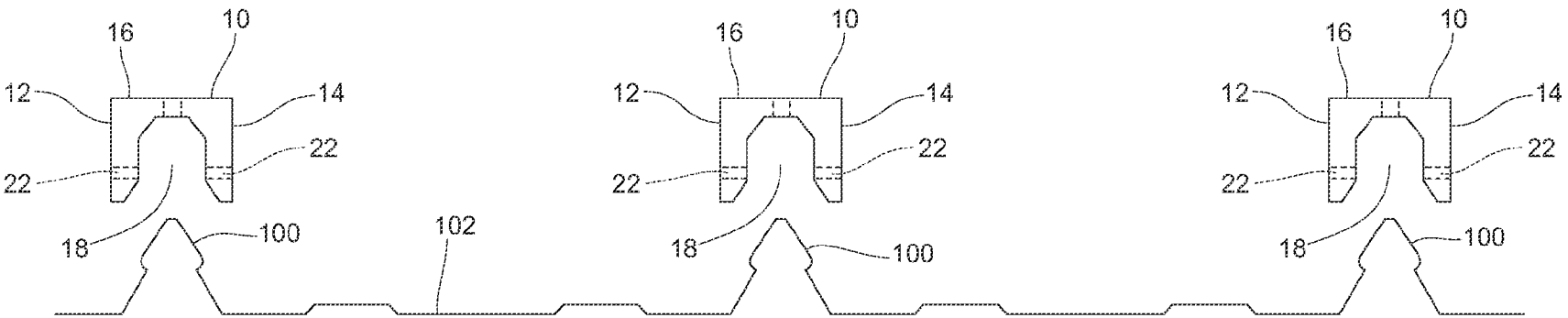
FIG. 6 is an end view of two roof panels joined at a center rib with anchors over roof panel ridges.
Figure 7:
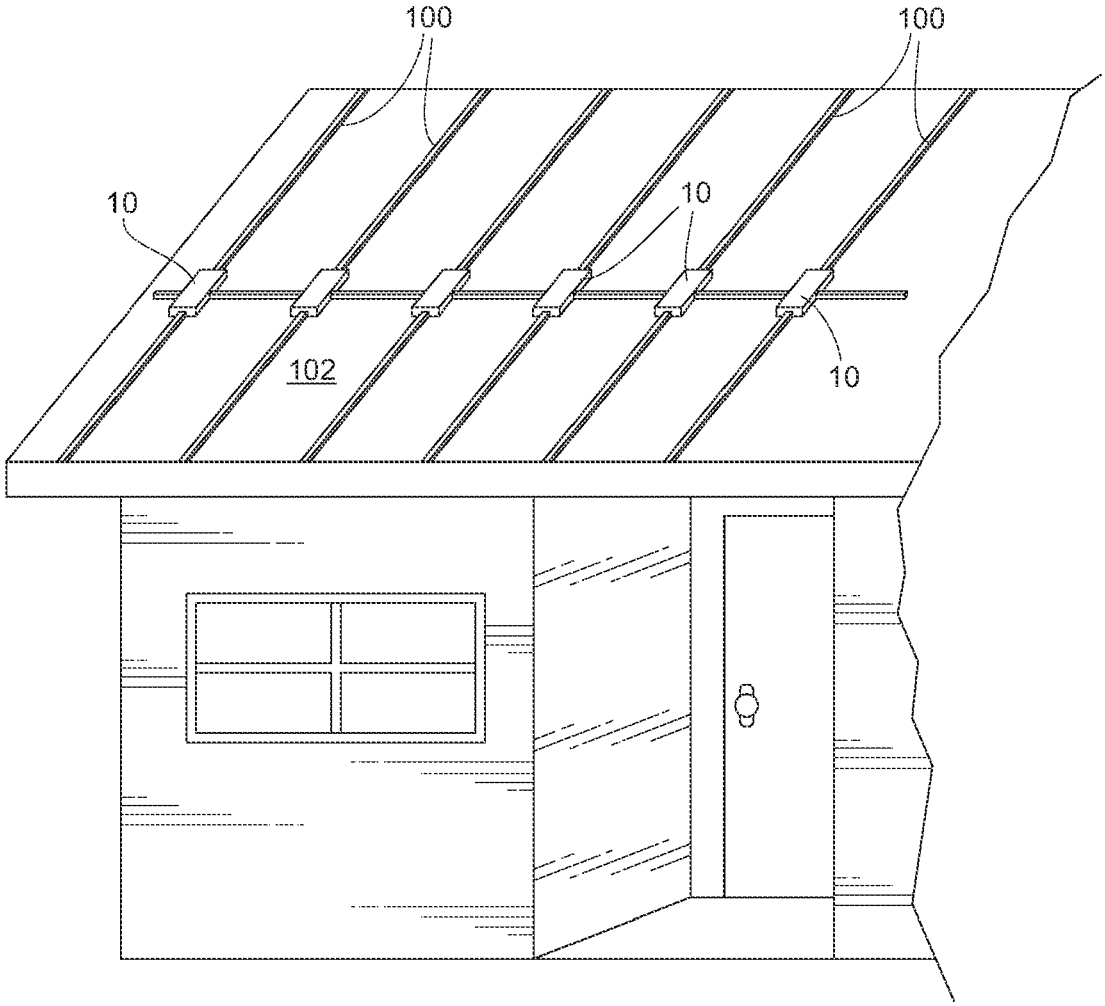
FIG. 7 is a perspective view of a building having roof panels with roof panel ribs to which a plurality of anchors are attached to secure a snow guard.

A roof panel rib anchor 10 for attachment to a roof panel rib 100 of a roof panel 102 or panels comprises first and second opposing anchor sides 12 and 14 depending from an anchor top 16 forming a channel 18 within and sized to receive a roof panel rib in the channel. A fastener spaced apart from the anchor top 16 on a first anchor side 12 extends into the channel 18 directed toward the other anchor side 14 at least partially closes the channel 18. Typically, the fastener comprises a threaded setscrew 20 and more typically a plurality of threaded setscrews penetrating at least a first anchor side 12 through matching threaded holes 22. When tightened into the channel 18, the setscrews 20 releasably clamp the roof panel rib 100 securely between the setscrew 20 and the second anchor side 14 with clamping force sufficient to prevent the anchor from sliding on the roof panel rib. When the setscrews are on both anchor sides, they may be arranged in opposing pairs, with a setscrew from the first side directed to a setscrew from the second side 14.

Commonly, the anchor 10 includes an attachment mechanism to which other roof paraphernalia, such as a snow guard, may be attached. In the figures, an attachment bolt 5 is shown threaded into a hole 7 in the anchor top 16. The attachment bolt 5 is then useful for connecting the anchor to such roof paraphernalia, for example, by passing the bolt through a paraphernalia bolt hole and then into the anchor threaded hole.

Commonly, the roof panel rib 100 comprises a rib head 108 supported by a rib base 110 that narrows to a rib neck 112 smaller than the rib head 108 at its intersection 114 with the rib head 108. It further has a cavity, or channel, 104 between two rib walls 106. To prevent collapse of the cavity 104 when clamping force is applied, a rib bar 24 suitably sized fits within the roof panel rib cavity 104 opposite the setscrews 20. The bar comprises an elongated body 25 unattached generally except as may be bound by said set screw and unattached specifically to the roof and to the roof rib with cross section shaped to approximately or at least functionally match said roof panel rib cavity or channel 104, maintaining the shape and structural integrity of the roof panel rib 100 against forces of attachment of an anchor to the roof panel rib. The roof panel rib wall 106 is then sandwiched between the setscrew 20 on its outside and the bar 24 on its inside and the roof panel rib is thus braced from collapse or substantial deformation.

When the neck 110 is smaller in cross section than the head 112, the setscrews 20 typically are located in the anchor sides 12 and 14 such that when a roof panel rib is received in the anchor 10, the setscrews 20 tighten into the roof rib and bar at the intersection of the bar head and neck (corresponding to the roof rib head and neck) undercutting the roof panel rib head 112 when tightened into the channel at the roof panel rib neck 110 at least partially closing the channel 18 therein preventing it from passing out of the channel 18.

To avoid damage to the roof panel head and the neck by threads 30 of the setscrew 20, the set screw comprises a threaded rod 31 with screw threads 30 ending intermediate the setscrew 20, leaving a smooth cylindrical rod 32 extending from and coaxial with the threaded rod 31 terminating on a rounded (meant to included all curvilinear surfaces) setscrew end 34 having a smooth abutment surface 36. The setscrew end 34 is therefore spaced apart substantially from the threads 30 by the smooth rod 32. The end 34 is integral the smooth rod 32 for structural integrity with its smooth abutment surface 36 blending smoothly and continuously into the smooth rod 32 leaving no corners, protrusions or edges that could tear the roof rib.

Where the bar 24 is made of soft metal, tightening a setscrew 20 into the bar 24 can create a dimple or depression 28 in the bar 24. As the setscrew 20 tightens the neck engages the rib bar depression 28 under the clamping force of the setscrew 20 to further securely engage the roof top. The rounded abutment surface of the setscrew is therefore advantageous in creating the dimple without tearing the roof panel rib.

The invention claimed is:

1. A roof panel rib anchor for attachment to a roof panel rib of a roof panel on a roof, the roof panel rib having a rib head supported from the roof panel on a rib base that narrows to a rib neck smaller than the rib head at its intersection with the rib head, the roof panel rib anchor comprising, first and second opposing anchor sides depending from an anchor top forming a channel within, adapted to receive said roof panel rib head and at least part of the roof panel rib neck in the channel, a threaded setscrew penetrating at least one anchor side through a matching threaded hole and separated from the anchor top such that said rib head is receivable in the channel between the setscrew and the anchor top, the setscrew securing the rib head in the channel when received therein, the setscrew intersecting the roof panel rib in the channel at the roof panel rib neck at least partially closing the channel such that said anchor head is prevented from passing out of the channel, the setscrew imparting clamping force on the roof panel rib neck preventing the anchor from sliding on the roof panel rib, a rib bar unattached generally except as may be bound by said setscrew and unattached specifically to said roof and said roof panel and, the rib bar being adapted to fit within the neck between the roof panel rib neck opposing sides bracing them from collapsing or suffering deformation in shape under said clamping force of said setscrew, substantially maintaining the shape and structural integrity of the roof panel under said clamping force.

* * * * *